United States Patent [19]

Salamone

[11] 4,234,192

[45] Nov. 18, 1980

[54] BI-DELTA VANE

[76] Inventor: Joseph L. Salamone, 25 Dempster St., Buffalo, N.Y. 14206

[21] Appl. No.: 76,865

[22] Filed: Sep. 19, 1979

[51] Int. Cl.[3] ..... F41B 5/02

[52] U.S. Cl. ..... 273/423

[58] Field of Search ..... 273/420, 423

[56] References Cited

U.S. PATENT DOCUMENTS

| | | | |
|---|---|---|---|
| 2,193,397 | 3/1940 | Dykes . | |
| 2,887,319 | 5/1959 | Lay | 273/423 |
| 2,989,310 | 6/1961 | Lamond . | |
| 3,071,127 | 1/1963 | Spack . | |
| 3,181,269 | 5/1965 | Nixon . | |
| 3,614,947 | 10/1971 | Feldman | 273/420 X |
| 3,865,374 | 2/1975 | Troncoso, Jr. | 273/423 X |
| 3,895,802 | 7/1975 | Bear | 273/423 |

*Primary Examiner*—Paul E. Shapiro

*Attorney, Agent, or Firm*—Bean, Kauffman & Bean

[57] ABSTRACT

A fletching element for an arrow includes relatively small leading and relatively large trailing guide vanes joined in spaced relationship by a mounting rib; the mounting edges of the guide vanes and the rib being adapted to be fixed to the rearward end of an arrow to assume a generally helical twist. Preferably, the spacing between vanes is such as to permit the rear edge of the leading vane to be arranged essentially in an adjacent annular offset relationship relative to the front edge of the trailing vane.

7 Claims, 5 Drawing Figures

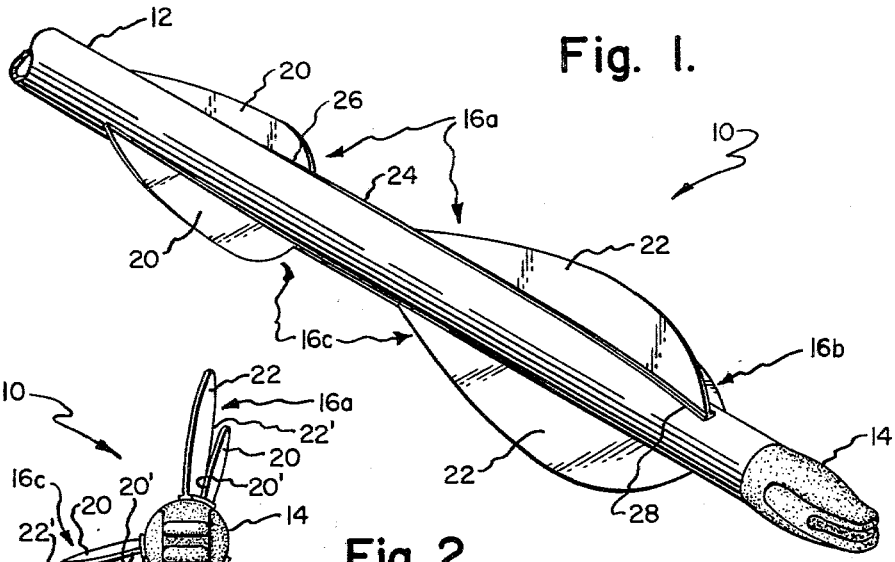
Fig. 1.
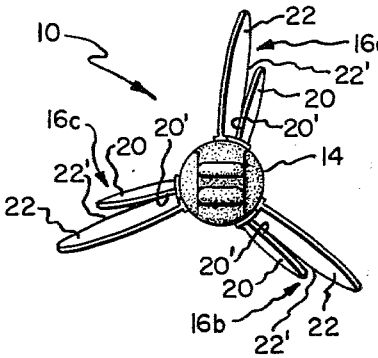
Fig. 2.
Fig. 3.
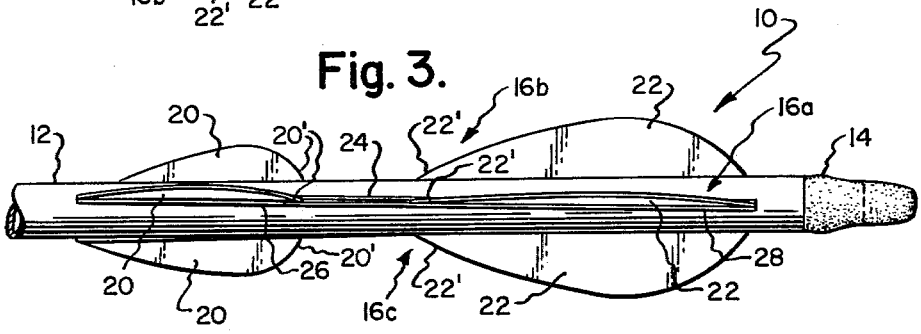
Fig. 4a
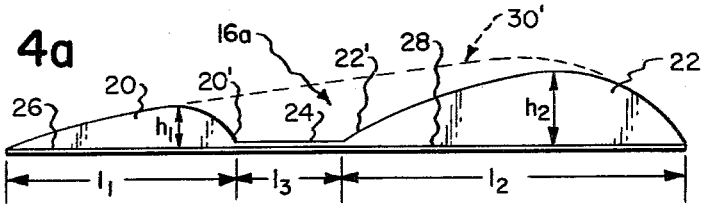
Fig. 4b.
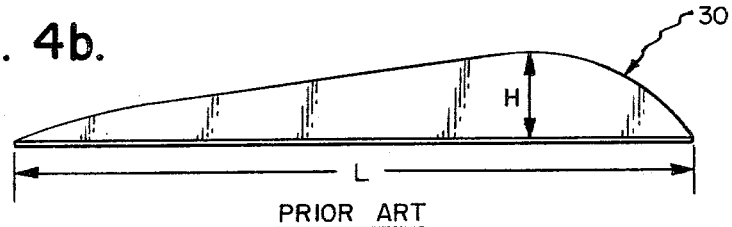
PRIOR ART

BI-DELTA VANE

BACKGROUND OF THE INVENTION

It is known that when an arrow is released from a bow, there is a tendency for the arrow to yaw or weave until it has traveled through a distance sufficient to permit its vanes to become effective to stabilize the arrow for straight flight to a target. This initial instability of an arrow, which is commonly referred to as "paradox", appears to be due at least in part to an initial bending or bowing of the shaft of the arrow, incident to its release.

It has also been recognized, as evidenced by U.S. Pat. No. 2,887,319, that "paradox" adversely effects the accuracy and penetration power of an arrow, and accordingly, that it is desirable to achieve steady flight attitude or conditions in the minimum possible time. In this prior patent, it is proposed to minimize "paradox" by providing the guide vanes or fletching elements of an arrow with holes, slots or the like.

SUMMARY OF THE INVENTION

The present invention is directed towards an improved fletching element for arrows and more particularly towards a fletching element adapted to minimize paradox and thus reduce the period of flight time necessary for an arrow to achieve a steady flight attitude.

In accordance with the present invention, there is provided a fletching element for arrows, which comprises relatively small leading and relatively large trailing guide vanes joined in a spaced relationship by a mounting rib. The mounting edges of the guide vanes and the rib are adapted to be fixed, as by adhesive bonding, to the rearward end of an arrow, such that the fletching element assumes a general helical twist with the rear edge of the leading vane preferably arranged in an adjacent annular offset relationship relative to the front edge of the trailing vane. After mounting of the guide vanes, the mounting rib may be cut away, as desired, without adversely effecting the performance of the arrow.

The term "helical twist", as applied to the present construction, is meant to include alternative constructions wherein the mounting edge of the leading guide vane follows either a helical path or assumes a straight line offset relationship relative to the shank of the arrow.

DRAWINGS

The nature and mode of operation of the present invention will now be more fully described in the following detailed description taken with the accompanying drawings wherein:

FIG. 1 is a perspective view of an arrow fletched in accordance with the present invention;

FIG. 2 is a rear view thereof;

FIG. 3 is a top plan view thereof;

FIG. 4*a* is a side elevational view of a fletching element formed in accordance with the present invention;

FIG. 4*b* is a side elevational view of a prior commercially available fletching element from which that of the present invention may be fabricated.

DETAILED DESCRIPTION

Reference is now made to FIGS. 1–3, wherein an arrow fletched in accordance with the present invention is generally designated as 10 and shown as including a shaft 12 having a slotted rear portion 14 adapted to receive a bow string, not shown; and a plurality of fletching elements or guide vane devices 16*a*, 16*b* and 16*c*. Shaft 10 may be conventional in all respects, and selectively sized, constructed and provided with a point suitable for target shooting or hunting purposes, as desired.

As with the case of conventional fletching elements, each set of elements 16*a*, 16*b* and 16*c* are preferably identically sized and equally spaced apart annularly of shaft 10 immediately adjacent its rearward end. Further, the fletching elements of the present invention may be positionally fixed to shaft 10 by any suitable adhesive and with the aid of a conventional fletching jig, not shown, of the type adapted to impart a relatively uniform right or left hand helical twist or offset to the elements, as desired, in order to impart spin to arrow 10 during flight. The degree of twist or offset of the fletching elements is a matter of choice, but preferably would be on the order of about 6°, as best shown in FIG. 3 in the case of fletching element 16*a*. The number of fletching elements to be fixed to any given arrow shaft is a matter of choice, but three element fabrications are preferred.

Fletching elements formed in accordance with the present invention depart from prior fletching practice principally in that each element, as formed, preferably includes a relatively small leading guide vane 20 and a relatively large trailing guide vane 22, which are interconnected in a prescribed spaced relationship by a mounting rib 24 formed as a continuation of the mounting edges or flanges 26 and 28 of vanes 20 and 22, respectively. Preferably, the vane-web portions of guide vanes 20 and 22 would be relatively thin and flexible and have their free or unattached edges smoothly contoured in a manner consistent with known fletching practice. Moreover, any conventional fletching material would appear suitable for use in fabricating the present fletching elements.

As by way of example, a fletching element formed in accordance with the present invention has been cut by hand from a low profile fletching element of the type designated as 30 in FIG. 4*b*, which is available commercially under the name "Ultra Vane". This prior vane is mold formed from a resiliently deformable plastic material having a vane-web portion thickness of less than 1/64 inch and overall "H" and "L" measurements of about 15/32 inch and 4 inches, respectively. When hand held at one end, vane 30 bows under the influence of gravity, and its vane-web portion is easily deflected by touch when its mounting edge is fixed to an arrow shaft.

By reference to FIG. 4*a*, it will be understood that fletching element 16*a* (as well as elements 16*b* and 16*c*) were formed by cutting away the mid-portion of the vane-web portion of element 30, as at 30', to provide leading guide vane 20 with "$h_1$" and "$l_1$" measurements of about $\frac{1}{4}$ inch and $1\frac{3}{8}$ inch, respectively; trailing guide vane 22 with "$h_2$" and "$l_2$" measurements of about 13/32 inch and 2 inches, respectively; and connecting rib with an "$l_3$" measurement of about $\frac{5}{8}$inch. This fletching element was sized for use in target shooting with an arrow having a shaft length on the order of about 30 inches.

Fletching elements of this size/configuration discussed above in reference to FIG. 4*a* have proved quite effective in minimizing paradox, as compared to 4 inch vanes of the type illustrated in FIG. 4*b* from which the present fletching elements have been fabricated; conventional 2 inch vanes, which are similar in size/configuration to trailing guide vane 22; and 4 inch vanes of the type illustrated in FIG. 4*b*, but which have been modified by the provision of apertures in their vane-web portions in accordance with the teachings of prior U.S. Pat. No. 2,887,319. Further, fletching elements of the present construction have been unexpectedly found to provide a noise level and/or pitch noticeably lower than that of conventional fletching elements of comparable size. This latter aspect of the invention is particularly desirable when arrows fletched in the manner described above are to be used for hunting. However, for an arrow intended to be used for hunting, it would be desirable to increase the overall length of the fletching element discussed above with reference to FIG. 4*a*, such as for instance to about 5 inches, and provide for proportional increases in the values of "$h_1$", "$h_2$", "$l_1$" and "$l_2$". Such increase in size of the leading and trailing guide vanes would not appear to require any significant change in the value of "$l_3$" providing that the degree of twist or offset of the fletching elements remain the same.

As by way of evaluating performance of arrows fletched in accordance with the present invention, series of comparative tests were conducted using a Jennings brand compound bow, Model "T" Hunter, peaking at 54.5 lbs., breaking at 29.5 lbs. and using a draw length of 29 inches. The bow was equipped with a Berger Button and Flipper II arrow rest, with a 14 strand bow-string made of Dacron B-50 material and a 0.021 diameter monofilament serving with a permanent knok point set at 5/16 inches above "Zero line" of a Patawatomi bow square. The bow was tuned for an Eastin Aluminum XX75, 2018, 30 inch arrow shaft equipped with a 125 grain point. All arrows used for test purposes were Eastin Aluminum X7, 1816,28 ⅞ inches long and equipped with standard target points. All vanes used for test purposes were derived from a 4 inch low profile "Ultra Vane" and had a helical twist or offset of 6°.

In a first series of tests, a target distance of 20 yards (indoor range) was established and an electronic condensor microphoned cassette deck was placed five feet before and to one side of the target. The test results are as follows:

Arrow No. I:

This arrow was fletched using elements sized and configured in the manner discussed above with reference to FIG. 4*a* with a helical twist being imparted to the trailing guide vane and a straight offset being imparted to the leading guide vane. It was noted that arrow flight was exceptional, grouping was excellent (maximum of 1½ inches separation between arrows) and the noise level and pitch were noticeably low.

Arrow No. II:

This arrow was fletched with conventional 2 inch straight offset vanes whose size, configuration and placement corresponded to the trailing guide vane of Arrow No. I. It was noted that arrow flight and grouping were good (maximum of 3 inches separation between arrows), except that tail wobble was noticeable. Noise level appeared comparable to Arrow No. I, but a higher pitch level was discernible.

Arrow No. III:

This arrow was fletched in a manner identical to Arrow No. II, with the exception that the vanes were provided with a helical twist. It was noted that arrow flight was excellent, and grouping was very good (maximum of 2 to 2½ inches separation between arrows). The noise level encountered was higher than Arrows I and II with Arrow III displaying about the same pitch level as Arrow II.

Arrow No. IV:

This arrow was fletched with vanes sized and shaped in the manner discussed above with reference to FIG. 4*b;* the vanes having been provided with a helical twist. Further, the vanes were formed with apertures with a view towards stimulating vanes disclosed in U.S. Pat. No. 2,887,319. Flight of this arrow was not as stable as previously tested Arrows I, II and III, although the grouping was good. However, the noise and pitch levels were noticeably excessive being substantially higher than any of Arrows I, II or III.

Arrow No. V:

This arrow was fletched in a manner identical to Arrow No. IV, except that no holes or apertures were provided in the vane-web portions of the vanes. It was noted that arrow flight was excellent, grouping was very good, but that the noise and pitch levels noticeably exceeded those encountered with Arrow No. I.

Arrow No. VI:

This arrow was fletched in a manner comparable to Arrow No. I with the exception that the leading guide vanes were provided with a helical twist and that the distance between the leading and trailing guide vanes was increased to more than ¾ inch. Arrow flight was found to be good with only fair grouping (excess of 3 inches separation between arrows). The noise and pitch levels appear to be the same as those encountered with Arrow No. I.

Initially, it was thought that the reduced performance level obtained with Arrow No. VI was due both to the excessive spacing between the leading and trailing guide vanes and the provision of the leading vane of Arrow No. VI with a helical twist. However, in subsequent tests it was determined that provision of the leading guide vane with a helical twist, as opposed to a straight offset, was not detrimental to arrow performance for any given spacing between the leading and trailing guide vanes. Rather, it was found that the size of the spacing between the guide vanes accounted for changes in arrow performance. Specifically, it was noted that the best results were obtained with guide vane spacings of between about ½ and ⅝ inches. For smaller spacings or separations of ¼ inch and zero inches, arrow performance was similar, but not as good. However, very noticeable decreases in arrow performance were encountered as spacing between the leading and trailing guide vanes was increased beyond ¾ inch.

The underlying reason for these differences in arrow performance noted as a result of variance of spacing between the leading and trailing guide vanes of the present fletching elements is not fully understood. However, upon visual inspection of the arrows, it was noted that for the present case, wherein the fletching elements are provided with a 6° helical twist or offset, a spacing of ⅝ inch places the rear or trailing edge 20' of the leading guide vane in an adjacent annular offset relationship relative to the front or leading edge 22' of the trailing guide vane, as best shown in FIG. 2. As the spacing between the guide vanes is diminished to about ½ inch, the radially inner or "root" portion of the front edge of the trailing guide vane-web portion passes into the shadow of the leading guide vane, but an actual reduction in performance does not appear to occur until the spacing is reduced to about ¼ inch when overlapping of the guide vanes has become noticeable. However, as the spacing between guide vanes is increased and a noticeable annular gap begins to open between the rear edge of the leading guide vane and the front edge of the trailing vane, as viewed from the rear end of the arrow, performance is progressively less satisfactory. Thus, a preferred spacing would appear to lie within a range permitting the rear edge of the leading guide vane to be arranged essentially in an adjacent annular offset relationship relative to the front edge of the trailing guide vane, that is a condition extending from where little or no annular gap exists between the radially inner or "root" portions of such rear and front edges to where only a relatively small portion of such rear and front edges overlap, as viewed from the rear of the arrow. Further, it would appear that the preferred spacing between the leading and trailing guide vanes will vary at least some extent, dependent upon the twist or offset angle of the fletching elements, as applied to the arrow shaft.

A second series of tests were conducted with a view toward evaluating the speed and kenetic energy of each of the arrow forms discussed above in connection with the first series tests. In conducting these tests, a Schmidt Weston Company Standard Chronograph having an accuracy of +0–1 ft. per sec. was arranged downstream of the arrow flight path. This equipment included two screens spaced two feet apart with first of these screens arranged at a point 42 inches from tips of the arrows when fired. Each arrow was weighed using an Ohaus Lyman Model #1010 scale, with an accuracy of ±0.0001 grain. Kenetic Energy (K.E.) was determined using formula $V^2 \times Wa/450250$. The results of this series of tests are tabulated below.

| Arrow | Weight (grains) | Speed (ft./sec.) | K.E. (Ft. Lbs.) |
|---|---|---|---|
| No. 1 | 364.5 | 220.8 | 39.47 |
| No. 2 | 357.5 | 217.3 | 37.49 |
| No. 3 | 360.0 | 220.0 | 38.70 |
| No. 4 | 368.5 | 214.2 | 37.55 |
| No. 5 | 373.8 | 214.4 | 38.16 |
| No. 6 | 360.5 | 215.0 | 37.01 |

Note:
Differences in weights of the arrows tested appear to be primarily due to weight variations experienced in commercially available arrow shafts and points.

In evaluating the results of the above tests, it was noted that arrows fletched in accordance with the preferred form of the present invention acquired the highest flight speed over the measured course and demonstrated the best flight performance and grouping characteristics. This evidences that the effects of paradox were reduced to a greater extent than that experienced with any of the other arrow fletching arrangements under consideration. Thus, by using arrows fletched in accordance with the preferred form of the present invention, an archer will be able to shoot well without tuning of his bow to the same degree, and will be able to use a lighter spined arrow for a heavier bow with confidence. Moreover, as indicated above, the lower noise and/or pitch level characteristic of the present fletching element will be found to be a desirable feature by bow hunters.

While fletching elements 16*a*, 16*b* and 16*c* have been disclosed as being hand cut from conventional fletching elements of the type illustrated in FIG. 4*b*, it will be understood that the present fletching elements will preferably be mold formed from a suitable plastic material for sale on a commercial basis. Further, it will be understood that the present fletching elements, as formed, would preferably include mounting rib 24, since the presence of such rib greatly facilitates the use of a conventional fletching jig in mounting the leading and trailing guide vanes on an arrow shaft and moreover, provides a built-in means of establishing the preferred spacing between guide vanes. However, as indicated above, the presence or absence of the mounting rib does not appear to influence arrow performance and therefore may be cut away or left in place, as desired. Thus, it is anticipated that the mounting rib may be dispensed with and the leading and trailing guide vanes of each of the fletching elements individually attached to the arrow shaft with or without assistance of a conventional fletching jig.

I claim:

1. A fletching element for an arrow of the type intended to be fixed to the shaft of the arrow to assume a given angle of helical twist or offset, said element comprising:

a leading guide vane having a mounting edge to be fixed to said arrow shaft;

a trailing guide vane having a mounting edge to be fixed to said arrow shaft, said trailing guide vane being relatively larger than said leading guide vane; and a mounting rib formed integrally with and extending between the mounting edges of the leading and trailing guide vanes.

2. A fletching element according to claim 1, wherein the length of said mounting rib is sufficient to position a rear edge of said leading guide vane essentially in an adjacent annular offset relationship relative to the front edge of said trailing vane when said fletching element is fixed to said arrow shaft to assume said given angle.

3. A fletching element according to claim 1, wherein the overall lengths of said leading and trailing guide vanes are about 1 3/8 inches and 2 inches, respectively; the overall heights of said leading and trailing guide vanes are about ¼ inch and 13/32 inch, respectively; and the length of said mounting rib is between about ½ inch and ⅝ inch.

4. An arrow having a shaft and a plurality of fletching elements fixed along mounting edges thereof to a rearwardly disposed end portion of said shaft to assume a given angle of helical twist or offset, the improvement comprising in combination:

each of said fletching elements includes a leading guide vane and a trailing guide vane, said leading guide vane being relatively smaller than said trailing guide vane and said leading guide vane having its rear edge disposed essentially in an adjacent annular offset relationship relative to the front edge of said trailing guide vane, as viewed from the rear end of said shaft.

5. An arrow according to claim 4, wherein said angle has a value of about 6°, and said leading guide vane is separated from said trailing guide vane in a direction measured along said shaft through a distance of between about ½ inch and ⅝ inch.

6. An arrow according to claim 4, wherein said angle has a value of about 6°; the overall lengths of said leading and trailing guide vanes are about 1 3/8 inches and 2 inches, respectively; the overall heights of said leading and trailing guide vanes are about ¼ inch and 13/32 inch, respectively; and said leading guide vane is separated from said trailing guide vane in a direction measured along said shaft through a distance of between about $\frac{1}{2}$ inch and $\frac{5}{8}$ inch.

7. An arrow according to claim 4, 5 or 6, wherein said leading and trailing guide vanes are interconnected by an integrally formed mounting rib extending between their mounting edges.

* * * * *